US009206009B2

(12) United States Patent
Iwatsuki

(10) Patent No.: US 9,206,009 B2
(45) Date of Patent: Dec. 8, 2015

(54) MEDIUM PROCESSING DEVICE

(71) Applicant: Oki Electric Industry Co., Ltd., Tokyo (JP)

(72) Inventor: Kei Iwatsuki, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/377,557

(22) PCT Filed: Dec. 13, 2012

(86) PCT No.: PCT/JP2012/082396
§ 371 (c)(1),
(2) Date: Aug. 8, 2014

(87) PCT Pub. No.: WO2013/140683
PCT Pub. Date: Sep. 26, 2013

(65) Prior Publication Data

US 2015/0001239 A1 Jan. 1, 2015

(30) Foreign Application Priority Data

Mar. 21, 2012 (JP) ..... 2012-063271

(51) Int. Cl.
*G06Q 40/00* (2012.01)
*B65H 29/00* (2006.01)
*B65H 43/08* (2006.01)

(52) U.S. Cl.
CPC ..... *B65H 29/006* (2013.01); *B65H 43/08* (2013.01); *B65H 2301/4144* (2013.01); *B65H 2301/41912* (2013.01); *B65H 2511/512* (2013.01); *B65H 2513/512* (2013.01); *B65H 2701/1912* (2013.01); *B65H 2701/37* (2013.01)

(58) Field of Classification Search
CPC ..... B65H 2301/41912; B65H 29/006; B65H 2701/1912; B65H 2403/732; B65H 2511/512; B65H 2513/512; B65H 2220/01; B65H 2220/02; B65H 2220/11; G07D 11/0006
USPC ..... 235/379
See application file for complete search history.

(56) References Cited

U.S. PATENT DOCUMENTS 4,504,876 A * 3/1985 Nagaoka ..... 360/94
2011/0073611 A1 3/2011 Tosaka et al.

FOREIGN PATENT DOCUMENTS

JP 2010-006494 A 1/2010

* cited by examiner

*Primary Examiner* — Thien M Le
*Assistant Examiner* — Tae Kim
(74) *Attorney, Agent, or Firm* — Rabin & Berdo, P.C.

(57) ABSTRACT

A medium processing device includes: a cylindrical drum; an inner tape that is withdrawn from an inner reel and are wound onto the drum; an outer tape that is withdrawn from an outer reel and are wound onto the drum together with the inner tape with a paper medium interposed therebetween; a contrasting region that has contrasting physical properties, and that is formed at a terminal-end portion of at least one of the tapes; a detection section that detects the physical properties on a contrasting tape that is one of the tapes formed with the contrasting region; and a controller that controls rotation of the drum based on a detection result of the detection section, wherein a normal tape that is one of the tapes not formed with the contrasting region, has a length that is longer than that of the contrasting tape by an additional length.

5 Claims, 19 Drawing Sheets

MEDIUM PROCESSING DEVICE

TECHNICAL FIELD

The present invention relates to a medium processing device that is, for example, well-suited to application in an automated teller machine (ATM) to which a medium, such as banknotes, is input to perform desired transactions.

BACKGROUND ART

Hitherto, automated teller machines, such as those utilized in financial institutions, allow a customer to pay in cash, such as coins and banknotes, and pay out cash to a customer, according to the contents of a customer transaction.

As such an automated teller machine, a configuration has been proposed that includes, for example, a banknote input/output port that accepts and dispenses banknotes for a customer, a classification section that classifies the denomination and authenticity of inserted banknotes, a temporary holding section that temporarily holds inserted banknotes, and denomination cassettes that store banknotes by denomination.

In this automated teller machine, when a customer has inserted banknotes into the banknote input/output port in a pay-in transaction, the inserted banknotes are classified in the classification section. The automated teller machine then holds banknotes classified as normal banknotes in the temporary holding section, and banknotes that are classified as unsuitable for use in the transaction are returned to the banknote input/output port and returned to the customer. Then, after the customer has approved the pay-in amount, the automated teller machine reclassifies the banknotes held in the temporary holding section by denomination in the classification section, and the banknotes are stored in the respective denomination cassettes according to their classified denomination.

As such a temporary holding section, a configuration has been proposed that includes, for example, a cylindrical rotating drum and two long tapes, in which one end of each of the respective tapes is fixed to a circumferential surface of the drum such that the two tapes are superimposed on one another (see for example FIG. 1 and FIG. 2 of Japanese Patent Application Laid-Open (JP-A) No. 2010-6494).

As illustrated in FIG. 13A and FIG. 13B, a conventional temporary holding section 315 includes, for example, a cylindrical drum 23 and one tape drive system 327. The tape drive system 327 includes an outer tape 330 and an inner tape 340 configured from transparent resin material, and an outer reel 31 and an inner reel 41 onto which the outer tape 330 and the inner tape 340 are wound. Terminal-end portions of the outer tape 330 and the inner tape 340 are respectively fixed to the outer reel 31 and the inner reel 41, and leading-end portions of both the outer tape 330 and the inner tape 340 are respectively fixed on the circumferential surface of the drum 23 while being superimposed on one another.

In a take-up operation, by rotating the drum 23 in a take-up direction R1 with the banknotes BL being interposed between the outer tape 330 and the inner tape 340, the temporary holding section 315 can wind banknotes BL onto the circumferential surface of the drum 23, together with the outer tape 330 and the inner tape 340. Moreover, in a rewind operation, the temporary holding section 315 can dispense the banknotes BL in sequence by rotating the drum 23 in a rewind direction R2 as the outer tape 330 and the inner tape 340 are respectively taken up onto the outer reel 31 and the inner reel 41.

As illustrated in FIG. 14, a light-blocking region SA that blocks light is formed at each of the leading end side (drum side) of the outer tape 330 and the terminal end side (reel side) of the inner tape 340. The temporary holding section 315 generates "bright" level light reception signals corresponding to transparent portions, and generates "dim" level light reception signals corresponding to the light-blocking regions SA, using a tape sensor 35 and a tape sensor 45 that illuminate and receive detection light.

During the take-up operation or the rewind operation of the tapes, a controller 21 of the temporary holding section 315 detects that the terminal-end portion or the leading-end portion has been reached based on detection results of the light reception signals, and stops rotation of the drum 23. The temporary holding section 315 is thereby capable of forestalling damage caused by imparting excessive tension when the outer tape 330 and inner tape 340 have been completely taken up onto the drum 23, or onto the outer reel 31 and inner reel 41.

DISCLOSURE OF INVENTION

Technical Problem

However, in the temporary holding section 315, when conveying or taking up a banknote BL that is creased or wrinkled, for example, the banknote BL may interfere with peripheral components and cause a blockage, which can lead to the respective tapes becoming entangled or snapping. There is also a possibility of a maintenance worker accidentally snapping the tapes during a maintenance operation.

In such an event, although the temporary holding section 315 should be repaired with a new replacement tape, as a temporary measure until the arrival of the new tape, the tape may be trimmed by cutting out the entangled portion of the tape, and joining the remaining portions together.

Here, assuming in the temporary holding section 315 that the outer tape 330, that is not formed with the light-blocking region SA at the terminal-end portion, has been trimmed. In such a temporary holding section 315, there is a concern that in a take-up operation, the terminal-end portion of the outer tape 330 could be reached before the tape sensor 45 detects the light-blocking region SA of the inner tape 340, leading to faulty operation or the possibility of imparting excessive tension to and snapping the outer tape 330, making normal operation impossible.

In consideration of the above circumstances, the present invention proposes a medium processing device capable of stable operation.

Solution to Problem

In order to address the above issue, a medium processing device of the present invention includes: a cylindrical drum that rotates about a central shaft; one or more inner tapes that are withdrawn from an inner reel on which the inner tapes are wound in advance and are wound onto a circumferential surface of the drum, at one or more locations in an axial direction along the central shaft of the drum; one or more outer tapes that are withdrawn from an outer reel on which the outer tapes are wound in advance and are wound onto the circumferential surface of the drum together with the inner tapes and a paper sheet shaped medium, with the medium interposed between the inner tape and the outer tapes; a contrasting region that has contrasting physical properties to other regions, and that is formed at a terminal-end portion that is an end portion at the inner reel side or the outer reel side of at least one of the inner tapes or the outer tapes; a detection section that detects the physical properties at a tape position between the drum and the inner reel or between the drum and the outer reel, on a contrasting tape that is one of the inner tapes or the outer tapes formed with the contrasting region at the terminal-end portion; and a controller that controls rotation of the drum based on a detection result of the detection section, wherein a normal tape that is one of the inner tapes or the outer tapes not formed with the contrasting region at the terminal-end portion, has a length in a length direction that is longer than that of the contrasting tape by an additional length.

Since the normal tape can maintain the same or a greater length than the contrasting tape even if the normal tape has been trimmed, it is possible to avoid reaching the terminal end of the normal tape before the detection section detects the contrasting region of the contrasting tape in a take-up operation. Application of excessive tension to each of the tapes can accordingly be prevented.

Effects of Invention

According to the present invention, since the normal tape can maintain the same or a greater length than the contrasting tape even if the normal tape has been trimmed, it is possible to avoid reaching the terminal end of the normal tape before the detection section detects the contrasting region of the contrasting tape in a take-up operation. Application of excessive tension to each of the tapes can accordingly be prevented. The present invention accordingly enables a medium processing device capable of stable operation to be achieved.

BEST MODE FOR CARRYING OUT THE INVENTION

Figure 1:
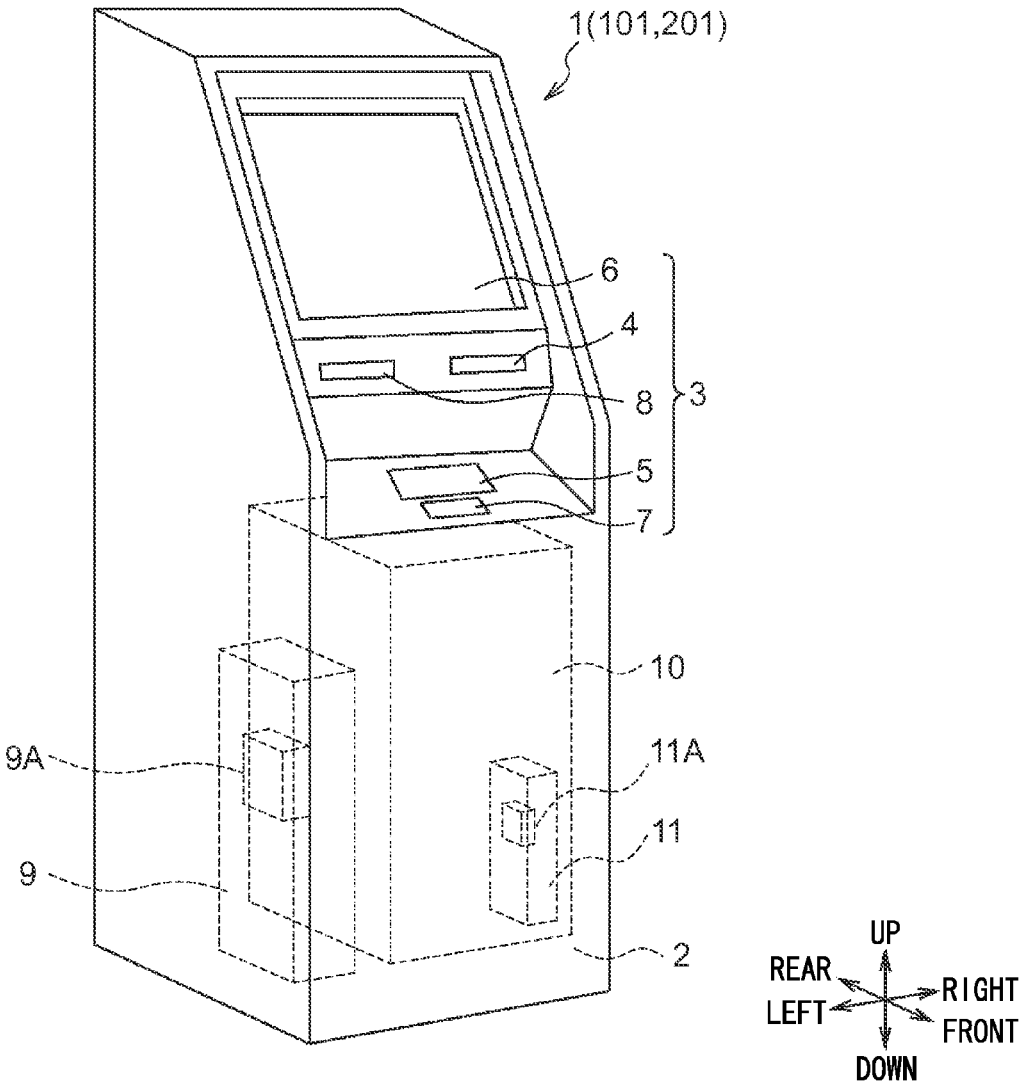
FIG. 1 is a schematic perspective view illustrating a configuration of an automated teller machine.

Explanation follows regarding exemplary embodiments of the present invention (referred to below as exemplary embodiments), with reference to the drawings.

1. First Exemplary Embodiment 1-1. Configuration of Automated Teller Machine Overall As illustrated in the external view of FIG. 1, an automated teller machine 1 is configured with a box shaped casing 2 as a main part, and is installed, such as in a financial institution, to perform cash transactions such as pay-in transactions and pay-out transactions with a customer.

The casing 2 is configured with a diagonally cut-away shape at a location enabling easy insertion of a banknote BL and easy operation of a touch panel by a customer facing the front side of the casing 2, namely at a portion spanning from a front face upper portion to the top face, with a customer interface 3 provided at this portion.

The customer interface 3 is, for example, configured to directly handle cash and passbook transactions with a customer, as well as to notify transaction-related information and receive operation instructions. The customer interface 3 is provided with a card input/output port 4, a pay-in/pay-out port 5, an operation display section 6, a ten-key 7, and a receipt issue port 8.

The card input/output port 4 is a portion for insertion and return of various cards, such as cash cards. A card processor (not illustrated in the drawings) that reads account numbers, for example, magnetically recorded on the various cards is provided behind the card input/output port 4.

The pay-in/pay-out port 5 is a portion into which banknotes BL for paying in are inserted by a customer, and where banknotes BL for paying out to a customer are dispensed. The pay-in/pay-out port 5 is opened up, or closed off, by driving a shutter. Note that banknotes BL are, for example, configured by rectangular shaped paper.

The operation display section 6 is integrated with a Liquid Crystal Display (LCD) that displays operation screens during transactions, and a touch panel that is input with, for example, a transaction type selection, a PIN, and a transaction amount.

The ten-key 7 is a physical keypad that is input with the numbers 0 to 9. The ten-key 7 is used during PIN and transaction amount input operations.

The receipt issue port 8 is a portion that issues a receipt printed with transaction details at the end of transaction processing. A receipt processor (not illustrated in the drawings) that prints transaction details on the receipt, for example, is provided behind the receipt issue port 8.

In the following explanation of the automated teller machine 1, the side facing a customer is defined as the front side, and the opposite side thereto is defined as the rear side.

The left side, right side, upper side and lower side are defined from the perspective of left and right as seen by a customer facing the front side.

A main controller 9 that performs integrated control of the overall automated teller machine 1, and a banknote pay-in/pay-out device 10 that performs various processing relating to the banknotes BL, are provided inside the casing 2.

The main controller 9 is configured around a Central Processing Unit (CPU), not illustrated in the drawings. The main controller 9 reads specific programs from, for example, Read Only Memory (ROM) or flash memory, not illustrated in the drawings, to perform various processing in pay-in transactions and pay-out transactions.

Inside the main controller 9 is a storage section 9A configured by, for example, Random Access Memory (RAM), a hard disk drive, and flash memory. The main controller 9 stores various data in the storage section 9A.

Open-and-closable doors are provided, for example, at portions of side faces, such as on the front face side or rear face side of the casing 2. Namely, as illustrated in FIG. 1, during cash transaction operations with customers, the respective doors are closed such that the banknotes BL stored inside the banknote pay-in/pay-out device 10 are protected by the casing 2. However, during a maintenance operation performed by an operator, the respective doors of the casing 2 are opened as required, enabling easy completion of tasks on each internal portion.

Figure 2:
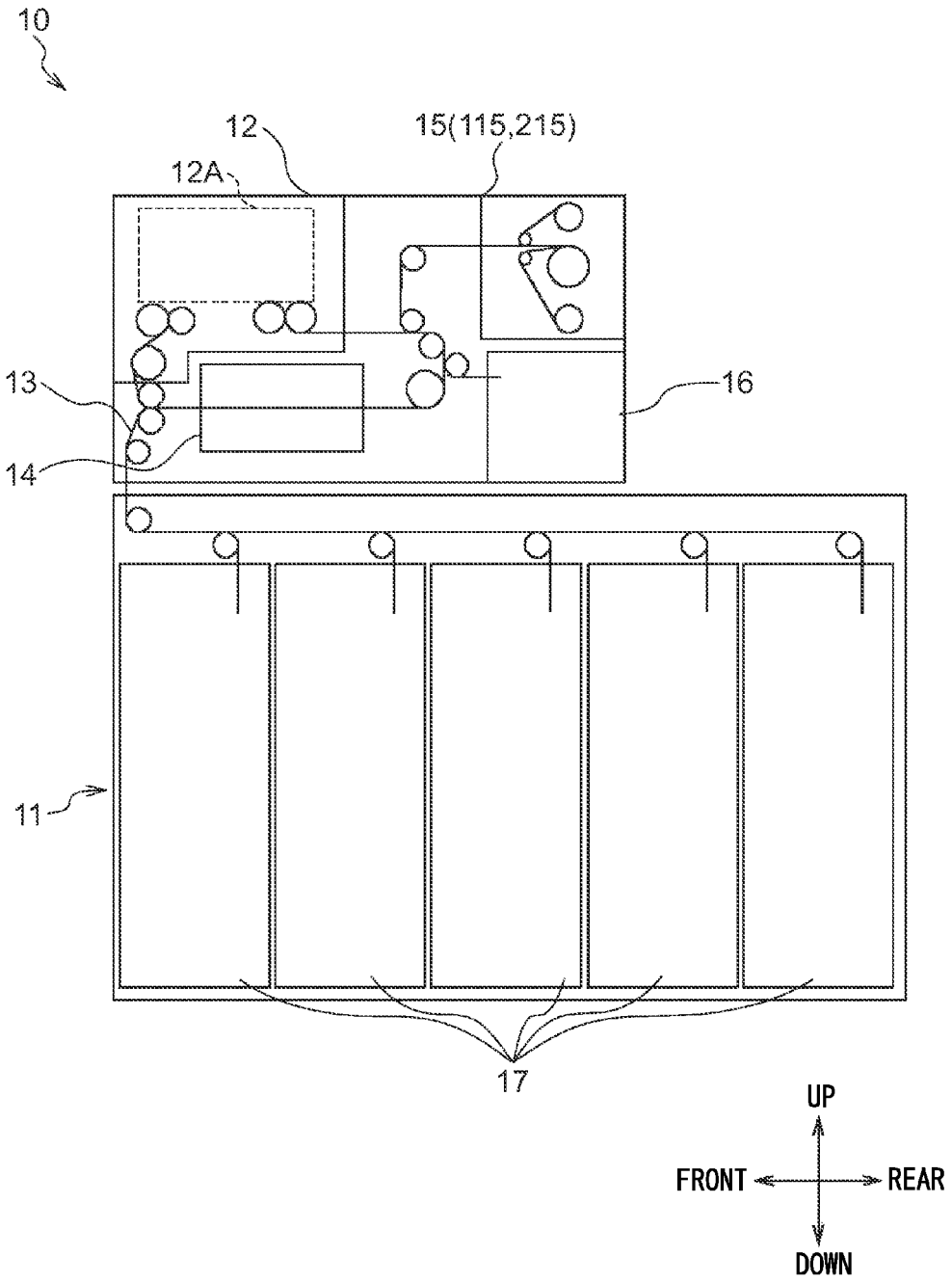
FIG. 2 is a schematic side view illustrating configuration of a banknote pay-in/pay-out device.

As illustrated in the side view of FIG. 2, the banknote pay-in/pay-out device 10 is configured by a combination of plural sections that perform various processing relating to the banknotes BL. Each portion of the banknote pay-in/pay-out device 10 is controlled by a banknote controller 11.

The banknote controller 11 is configured with a CPU as a main part, which is not illustrated in the drawings, similarly to the main controller 9. The banknote controller 11 reads and executes specific programs, such as from ROM or flash memory, not illustrated in the drawings, in order to perform various processing, such as processing to determine a banknote BL conveyance destination.

Inside the banknote controller 11 is a storage section 11A (FIG. 1) configured by, for example, RAM and flash memory. The banknote controller 11 stores various data in the storage section 11A.

For example, in a pay-in transaction where a customer pays in banknotes BL, after receiving specific operation input through the operation display section 6, the banknote controller 11 opens the pay-in/pay-out port 5 shutter to allow a customer to insert banknotes BL into a pay-in/pay-out section 12.

After the banknotes BL have been inserted into a receptacle 12A, the pay-in/pay-out section 12 closes the pay-in/pay-out port 5 shutter, takes the banknotes BL out of the receptacle 12A one note at a time, and passes the banknotes BL to a conveyance section 13. The conveyance section 13 conveys the banknotes BL, configured by rectangular shaped sheets of paper, to a classification section 14, with the short edge direction of the banknotes BL running along the direction of travel.

While conveying the banknotes BL inside, the classification section 14 classifies the banknotes BL according to, for example, denomination, authenticity, and degree of wear, by using optical devices, magnetic detection devices or the like, and notifies banknote BL classification results to the banknote controller 11. The banknote controller 11 determines the conveyance destination of the banknotes BL based on the acquired classification results.

In this case, the conveyance section 13, temporarily hold the banknotes BL that the classification section 14 has classified as normal banknotes by, for example, conveying them to a temporary holding section 15, and returns reject banknotes that are classified as unsuitable for transaction use to the customer by conveying them to the pay-in/pay-out section 12.

Next, the banknote controller 11 prompts the customer to approve the pay-in amount using the operation display section 6, causes the conveyance section 13 to convey the banknotes BL held in the temporary holding section 15 to the classification section 14, causes the classification section 14 to classify the banknotes BL according to, for example, denomination and degree of wear, and acquires the classification results.

The banknote controller 11 causes the conveyance section 13 to convey banknotes BL with a heavy degree of wear for storage in a reject cassette 16 as banknotes BL that are unsuitable for reuse, and causes the conveyance section 13 to convey banknotes BL with a light degree of wear to be stored by denomination in banknote cassettes 17 as reusable banknotes BL.

1-2. Configuration of Temporary Holding Section

Figure 3A:
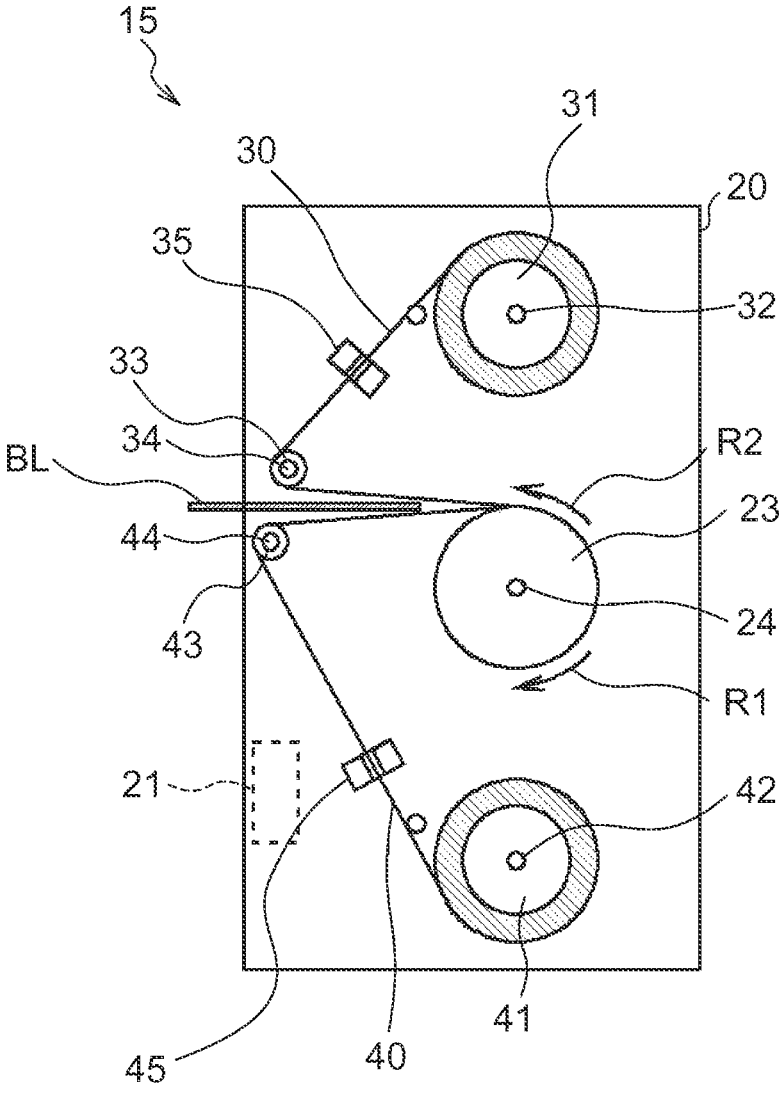
FIG. 3A is a right side view illustrating a configuration of a temporary holding section according to a first exemplary embodiment.

As illustrated in FIG. 3A, the temporary holding section 15 is configured with respective components attached to a frame 20.

Figure 3B:
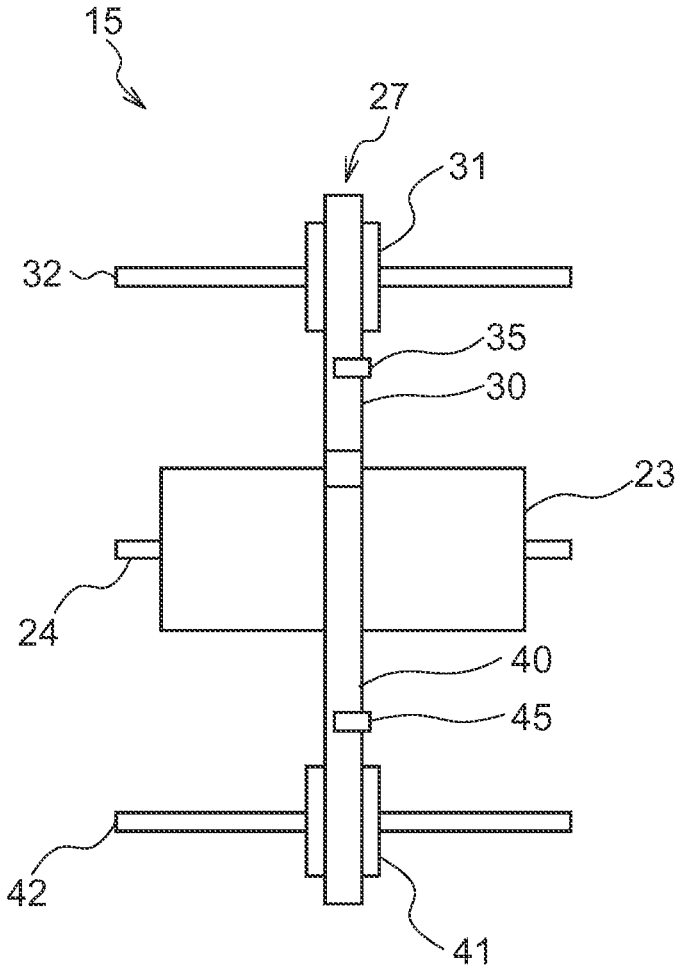
FIG. 3B is a rear side view illustrating a configuration of a temporary holding section according to the first exemplary embodiment.

Note that FIG. 3A and FIG. 3B are schematic views of the temporary holding section 15 as viewed from the right side and the rear side respectively. Some components, such as a motor and gears, have been omitted from illustration for ease of explanation.

A controller 21 performs overall control of the temporary holding section 15. The controller 21 is configured with a CPU as a main part, which is not illustrated in the drawings, similarly to the main controller 9 and the banknote controller 11 (FIG. 1). Working in conjunction with, for example, the banknote controller 11, the controller 21 reads and executes specific programs, such as from ROM or flash memory, not illustrated in the drawings, to perform various processing such as drum rotation and tape travel control.

Inside the controller 21 is a storage section configured by for example RAM and flash memory. Various data is stored in this storage section.

As illustrated in FIG. 3A and FIG. 3B, a cylindrical drum 23 is provided in the vicinity of the center inside the frame 20 of the temporary holding section 15. The drum 23 is attached to a rotation shaft 24 that is disposed along the left-right direction such that the drum 23 is capable of rotation in a take-up direction R1 or a rewind direction R2. Drive force from a motor, not illustrated in the drawings, is transmitted to the drum 23 under control of the controller 21.

A single tape drive system 27 is provided inside the temporary holding section 15, at substantially the left-right center. The tape drive system 27 drives two tapes, namely an outer tape 30 serving as a normal tape, and an inner tape 40 serving as a contrasting tape.

The outer tape 30 and the inner tape 40 are each formed in a thin film from a resin material with high light transmittance properties, and have sufficient length in the long direction while being sufficiently shorter than the long edge of a banknote BL in the short direction (namely the tape width).

An outer reel 31 is configured with a bobbin shape, and is provided above the drum 23 so as to rotate about a rotation shaft 32 that runs parallel to the rotation shaft 24 of the drum 23. The outer tape 30 is wound onto the outer reel 31 with one end of the outer tape 30 fixed to a circumferential surface of the outer reel 31.

A pulley 33 is provided at the front side of the drum 23. The pulley 33 is formed in a circular columnar shape, penetrated by a shaft 34 that runs parallel to the rotation shaft 24 of the drum 23, such that the pulley 33 is rotatable about the shaft 34.

A leading end of the outer tape 30, that is wound onto the outer reel 31, is pulled out (withdrawn) from the outer reel 31 toward the front and downwards, is entrained around the pulley 33 so as to fold back toward the rear, and is fixed to a circumferential surface of the drum 23.

Note that the outer reel 31 is biased toward a take-up direction of the outer tape 30 by a torque remitter, not illustrated in the drawings, such that the outer tape 30 is always under a specific tension.

An inner reel 41 is configured in a bobbin shape similarly to the outer reel 31, and is provided below the outer reel 31, namely below the drum 23, so as to be rotatable about a rotation shaft 42 that runs parallel to the rotation shaft 24 of the drum 23. The inner tape 40 is wound onto the inner reel 41 with one end of the inner tape 40 fixed to a circumferential surface of the inner reel 41.

Note that winding directions of the inner tape 40 on the inner reel 41 are the opposite directions to the winding directions of the outer tape 30 on the outer reel 31.

A pulley 43 is provided in front of the inner reel 41 and below the pulley 33. The pulley 43 is formed in a similar circular columnar shape to the pulley 33, penetrated by a shaft 44 that runs parallel to the rotation shaft 24 of the drum 23, such that the pulley 43 is rotatable about the shaft 44.

The other end of the inner tape 40 wound onto the inner reel 41 is pulled out from the inner reel 41 toward the front and upwards, is entrained around the pulley 43 so as to fold back toward the rear, and is fixed to the circumferential surface of the drum 23.

Similarly to the outer reel 31, the inner reel 41 is biased toward the inner tape 40 take-up direction by a torque remitter, not illustrated in the drawings, such that the inner tape 40 is always under a specific tension.

When the drum 23 of the thus configured temporary holding section 15 is rotated in the take-up direction R1, the inner tape 40 and the outer tape 30 are wound onto the circumferential surface of the drum 23, superimposed on one another.

When this is performed, interposing a banknote BL between the inner tape 40 and the outer tape 30 enables the temporary holding section 15 to wind the banknote BL, together with the inner tape 40 and the outer tape 30, onto the circumferential surface of the drum 23.

In the temporary holding section 15, banknotes BL are thereby wound onto the circumferential surface of the drum 23 by driving the two tapes (the outer tape 30 and the inner tape 40).

The tape drive system 27 is provided with a tape sensor 35 at a position where the outer tape 30 passes between the outer reel 31 and the pulley 33, namely at a position in the vicinity of the outermost peripheral portion of the outer tape 30 wound onto the outer reel 31.

The tape sensor 35 is configured by a light emitting portion that emits detection light at a specific wavelength, and a light receiving portion that receives the detection light, facing each other with one on each side of the outer tape 30. The tape sensor 35 emits detection light from the light emitting portion and generates a light reception signal according to the brightness of received detection light, that has passed through the outer tape 30 and been received by the light receiving portion. The light reception signal is output to the controller 21.

Namely, the tape sensor 35 is configured to output light reception signals to the controller 21 according to the transmissivity of the detection light at a detection light illumination location (referred to below as the tape position) of the outer tape 30.

The controller 21 determines the light reception signal acquired from the tape sensor 35 to be a "bright" level if it is a specific threshold value or above, and to be a "dim" level if it is below the threshold value. Namely, the determination results obtained by the controller 21 are the light transmissivity of the outer tape 30 at the position of the tape sensor 35 at the time of determination, binarized into a "bright" level or a "dim" level.

The tape drive system 27 is provided with a tape sensor 45 serving as a detection section of similar configuration to the tape sensor 35 at a position where the inner tape 40 passes between the inner reel 41 and the pulley 43, namely a position in the vicinity of the outermost peripheral portion of the inner tape 40 wound onto the inner reel 41.

Figure 4:
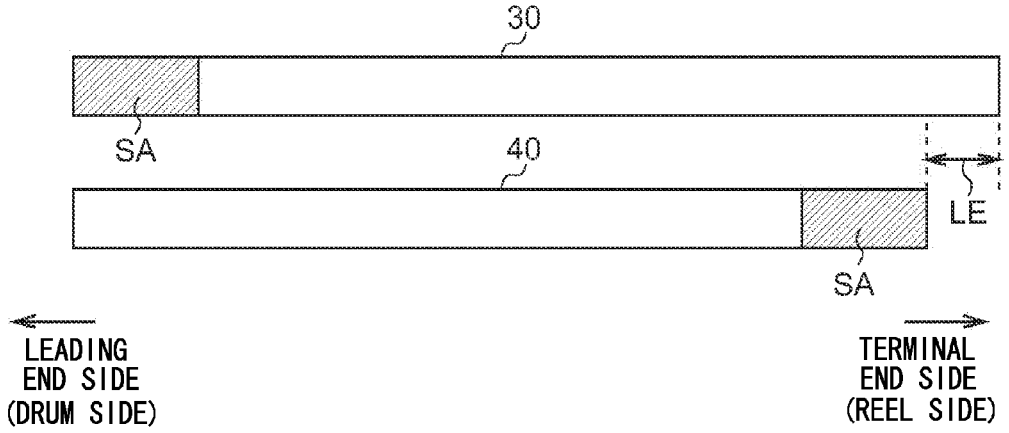
FIG. 4 is a schematic side view illustrating a configuration of tapes according to the first exemplary embodiment.

Corresponding thereto, as illustrated in FIG. 4, a terminal end side portion (referred to below as the terminal-end portion) of the inner tape 40 that is fixed to the inner reel 41 is formed with a light-blocking region SA, similar to that of the conventional inner tape 340.

The tape sensor 45 obtains a higher level light reception signal due to the detection light passing through the inner tape 40 when the tape position of the inner tape 40 is at a leading end side portion that is fixed to the drum 23 (referred to below as the leading-end portion), or a portion that is neither the leading-end portion nor the terminal-end portion (referred to below as the intermediate portion). However, the tape sensor 45 obtains a lower level light reception signal when the tape position of the inner tape 40 is the terminal-end portion, due to the detection light being blocked by the light-blocking region SA.

The inner tape 40 has a sufficient length of, for example, 30 m in the long direction, and has a length of, for example, 20 mm in the short direction (namely tape width), so as to be sufficiently shorter than the long edge of a banknote BL.

A leading-end portion of the outer tape 30 is formed with a light-blocking region SA that blocks the tape sensor 35 detection light, similarly to in the conventional outer tape 330.

Transparent portions of the outer tape 30, where the light-blocking region SA is not formed, accordingly allow the detection light of the tape sensor 35 to pass through, while the detection light is blocked at the light-blocking region SA.

Namely, the tape sensor 35 obtains a higher signal level light reception signal when the tape position of the outer tape 30 is at the intermediate portion or the terminal-end portion, due to the detection light passing through the outer tape 30. The tape sensor 35 obtains a lower level light reception signal when the tape position of the outer tape 30 is at the leading-end portion, due to the detection light being blocked by the light-blocking region SA.

The outer tape 30 has a longer length in the length direction (referred to below as the tape length) than the inner tape 40, by an additional length LE. The additional length LE is set longer than a length (referred to below as the cutout length LC) normally trimmed surrounding an entangled portion during a maintenance operation during a tape jam, and is, for example, approximately 150 mm.

Figure 5:
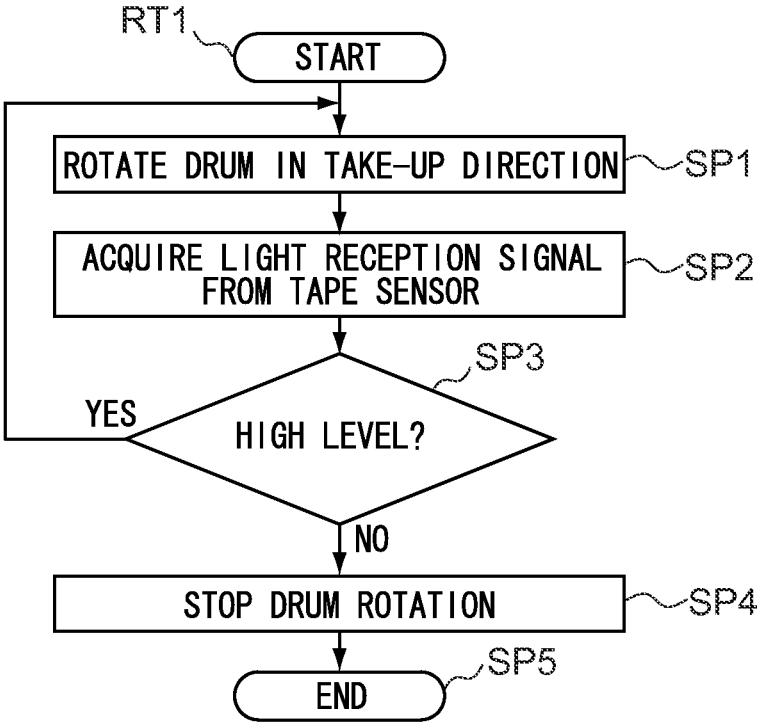
FIG. 5 is a flow chart illustrating a take-up processing sequence.
Figure 6:
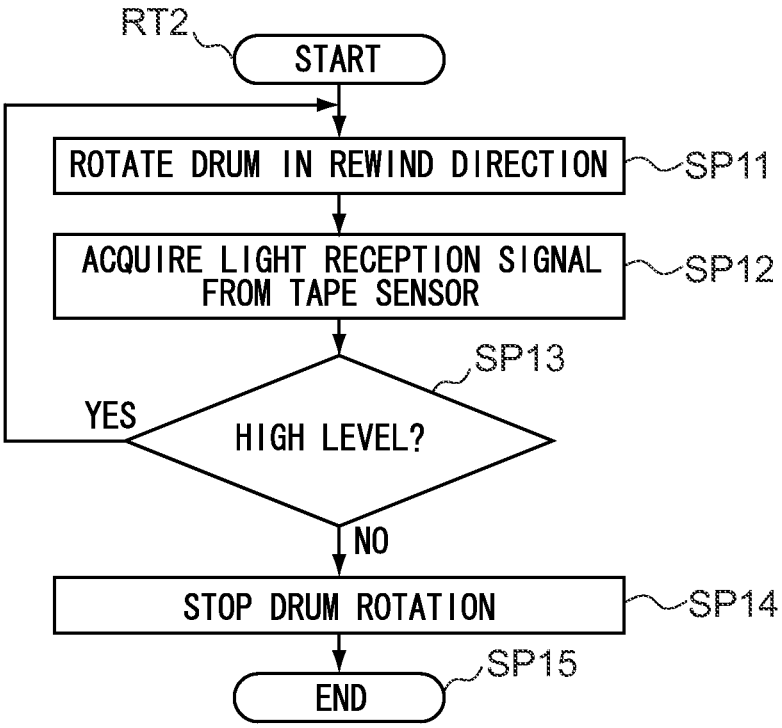
FIG. 6 is a flow chart illustrating a rewind processing sequence.

In order to sequentially take up the respective tapes and banknotes BL onto the drum 23, the controller 21 of the thus configured temporary holding section 15 controls rotation of the drum 23 or other operations as illustrated by the flow chart in FIG. 5.

Namely, when an instruction has been received, for example from the banknote controller 11 (FIG. 2), to hold banknotes BL in the temporary holding section 15, the controller 21 of the temporary holding section 15 starts a take-up processing sequence RT1 and transitions to step SP1.

At step SP1, the controller 21 rotates the drum 23 in the take-up direction R1, and transitions to the next step SP2. Note that the controller 21 controls a stepper motor, not illustrated in the drawings, to rotate the drum 23 by a specific angle at a time.

At step SP2, the controller 21 acquires a light reception signal from the tape sensor 45, and transitions to the next step SP3.

At step SP3, the controller 21 determines whether or not the acquired light reception signal is a "bright" level. Affirmative determination at this step indicates that the inner tape 40 terminal-end portion has not reached the position of the tape sensor 45. Namely, there is no concern of damaging the respective tapes in the temporary holding section 15, even with continued rotation of the drum 23 in the take-up direction R1. The controller 21 therefore returns to step SP1 and continues to rotate the drum 23.

However, negative determination at step SP3 indicates that the terminal-end portion of the inner tape 40, formed with the light-blocking region SA, has reached the position of the tape sensor 45. Namely, there is a concern that continued rotation of the drum 23 in the take-up direction R1 might damage the respective tapes in the temporary holding section 15. The controller 21 therefore transitions to the next step SP4.

At step SP4, the controller 21 stops rotation of the drum 23, and then transitions to the next step SP5 to end the take-up processing sequence RT1.

Note that the length of the light-blocking region SA from the terminal end of the inner tape 40 is appropriately set such that the light-blocking region SA reaches the position of the tape sensor 45 before the inner tape 40 that is taken up on the inner reel 41 has been fully pulled out.

When an instruction has been received, for example from the banknote controller 11 (FIG. 2), to externally dispense the banknotes BL held inside the temporary holding section 15, the temporary holding section 15 starts a rewind processing sequence RT2 and transitions to step SP11.

At step SP11, the controller 21 rotates the drum 23 in the rewind direction R2, and transitions to the next step SP12. At step SP12, the controller 21 acquires a light reception signal from the tape sensor 35 and transitions to the next step SP13.

At step SP13, the controller 21 determines whether or not the acquired light reception signal is a "bright" level. Affirmative determination at this step indicates that the leading-end portion of the outer tape 30 has not yet reached the position of the tape sensor 35. Namely, there is no concern of damaging the respective tapes in the temporary holding section 15, even with continued rotation in the drum 23 rewind direction R2. The controller 21 therefore returns to step SP11 and continues rotation of the drum 23 in the rewind direction R2.

However, negative determination at step SP13 indicates that the leading-end portion of the outer tape 30, formed with the light-blocking region SA, has reached the position of the tape sensor 35. Namely, there is a concern that continued rotation of the drum 23 in the rewind direction R2 might damage the respective tapes in the temporary holding section 15. The controller 21 therefore transitions to the next step SP14.

At step SP14 the controller 21 stops the rotation of the drum 23, and transitions to the next step SP15 to end the rewind processing sequence RT2.

Note that the length of the light-blocking region SA from the leading end of the outer tape 30 is appropriately set such that the light-blocking region SA reaches the position of the tape sensor 35 before the outer tape 30 that is wound onto the circumferential surface of the drum 23 has been completely rewound.

1-3. Operation and Effects

The temporary holding section 15 of the first exemplary embodiment configured as described above uses the tape sensor 35 to detect the light-blocking region SA provided at the leading-end portion of the outer tape 30, and uses the tape sensor 45 to detect the light-blocking region SA provided at the terminal-end portion of the inner tape 40.

During a take-up operation of the drum 23, the temporary holding section 15 is accordingly capable of determining the tape position to be at the terminal-end portion by detecting the light-blocking region SA of the inner tape 40, and stopping the rotation of the drum 23.

During a rewind operation of the drum 23, the temporary holding section 15 is capable of determining the tape position to be the leading-end portion by detecting the light-blocking region SA of the outer tape 30, and stopping the rotation of the drum 23.

In the temporary holding section 115, when conveying or taking up a banknote BL that is creased or wrinkled, for example, the banknote BL may interfere with peripheral components and cause a blockage, which can lead to the respective tapes becoming entangled or snapping. There is also a possibility of a maintenance worker accidentally snapping the tapes during a maintenance operation.

Figure 7:
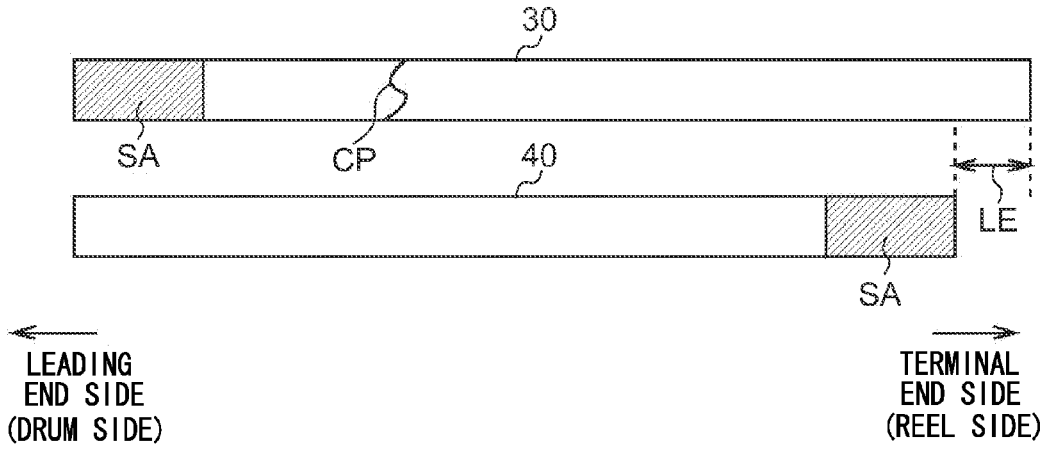
FIG. 7 is a schematic drawing illustrating a trimmed state of a tape in the first exemplary embodiment.

In such an event, although the temporary holding section 15 should be repaired with a new replacement tape, as a temporary measure until the arrival of the new tape, the tape may be trimmed by cutting out the entangled portion of the tape, and joining the remaining portions together at a joint location CP as illustrated in FIG. 7.

Here, the length of the outer tape 30 in the temporary holding section 15 is configured longer than the inner tape 40 by the additional length LE, namely by sufficiently longer than the cutout length LC.

Accordingly, in the temporary holding section 15, as illustrated in FIG. 7, the outer tape 30 can still maintain a greater length than the inner tape 40, even in the event that, for example, an obstruction occurred and the outer tape 30 has been trimmed by the cutout length LC.

Moreover, in the temporary holding section 15, even supposing the inner tape 40 being trimmed by the cutout length LC, the outer tape 30 can obviously still be maintained longer than the inner tape 40.

Accordingly, in the temporary holding section 15, even if the take-up operation is performed in a state in which either the outer tape 30 or the inner tape 40 has been trimmed, the tape sensor 45 may still detect the light-blocking region SA of the inner tape 40, and is able to stop rotation of the drum 23, before reaching the terminal-end portion of the outer tape 30. There is accordingly no concern of imparting excessive tension to and damaging either tape.

Note that in a case in which the outer tape 30 or the inner tape 40 is trimmed as a temporary measure in a maintenance operation of the automated teller machine 1, replacement with a new tape is carried out relatively quickly (for example, on the following day). Namely, a trimming operation would only be performed once at the most to the outer tape 30 or the inner tape 40.

Accordingly, setting the outer tape 30 with the additional length LE, longer than the cutout length LC for a single occasion, enables sufficient preparation to be made for a trimming operation.

Moreover, in contrast to the conventional temporary holding section 315, in the temporary holding section 15 it is sufficient simply to extend the outer tape 30. Any increase in the number of components, increased manufacturing process complexity, and an increase in costs associated with providing additional tape sensors and light-blocking regions can accordingly be kept to a minimum.

According to the above configuration, in the temporary holding section 15 according to the first exemplary embodiment, the light-blocking region SA provided at the terminal-end portion of the inner tape 40 is detected by the tape sensor 45 in order to determine that the tape position in a take-up operation of the drum 23 is the terminal-end portion and to stop the rotation of the drum 23. Moreover, in the temporary holding section 15, the tape length of the outer tape 30 is configured longer than the inner tape 40 by the additional length LE, enabling the outer tape 30 to be maintained longer than the inner tape 40 even if the outer tape 30 has been trimmed The temporary holding section 15 accordingly detects the light-blocking region SA of the inner tape 40 with the tape sensor 45 and stops rotation of the drum 23 before reaching the terminal-end portion of the outer tape 30, thereby enabling damage to the respective tapes as a result of imparting excessive tension to be forestalled.

2. Second Exemplary Embodiment

An automated teller machine 101 (FIG. 1) according to a second exemplary embodiment differs from the automated teller machine 1 according to the first exemplary embodiment in the point that a temporary holding section 115 is provided in place of the temporary holding section 15. Other portions are of similar configuration.

2-1. Configuration of Temporary Holding Section

Figure 8A:
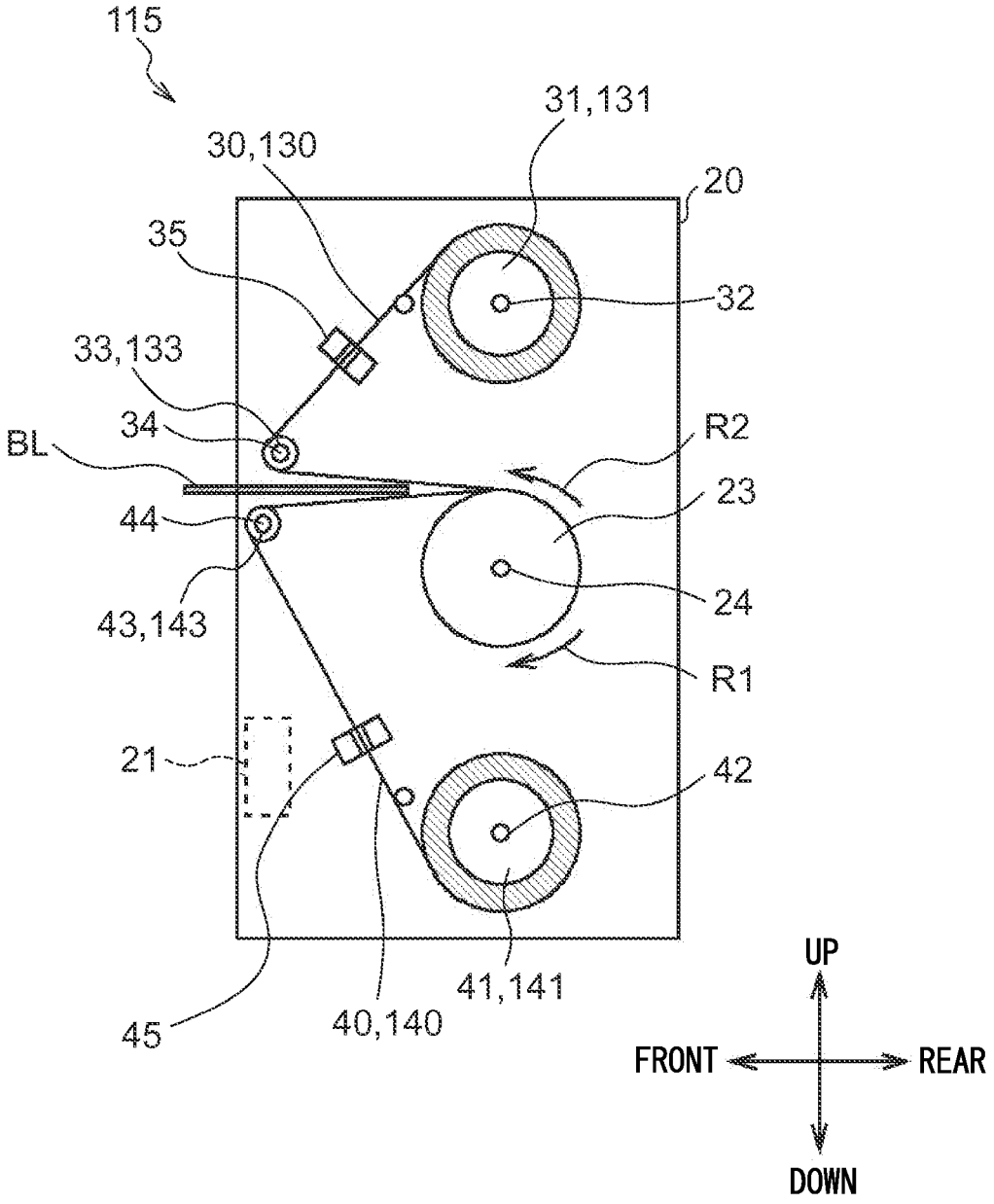
FIG. 8A is a right side view illustrating a configuration of a temporary holding section according to a second exemplary embodiment.
Figure 8B:
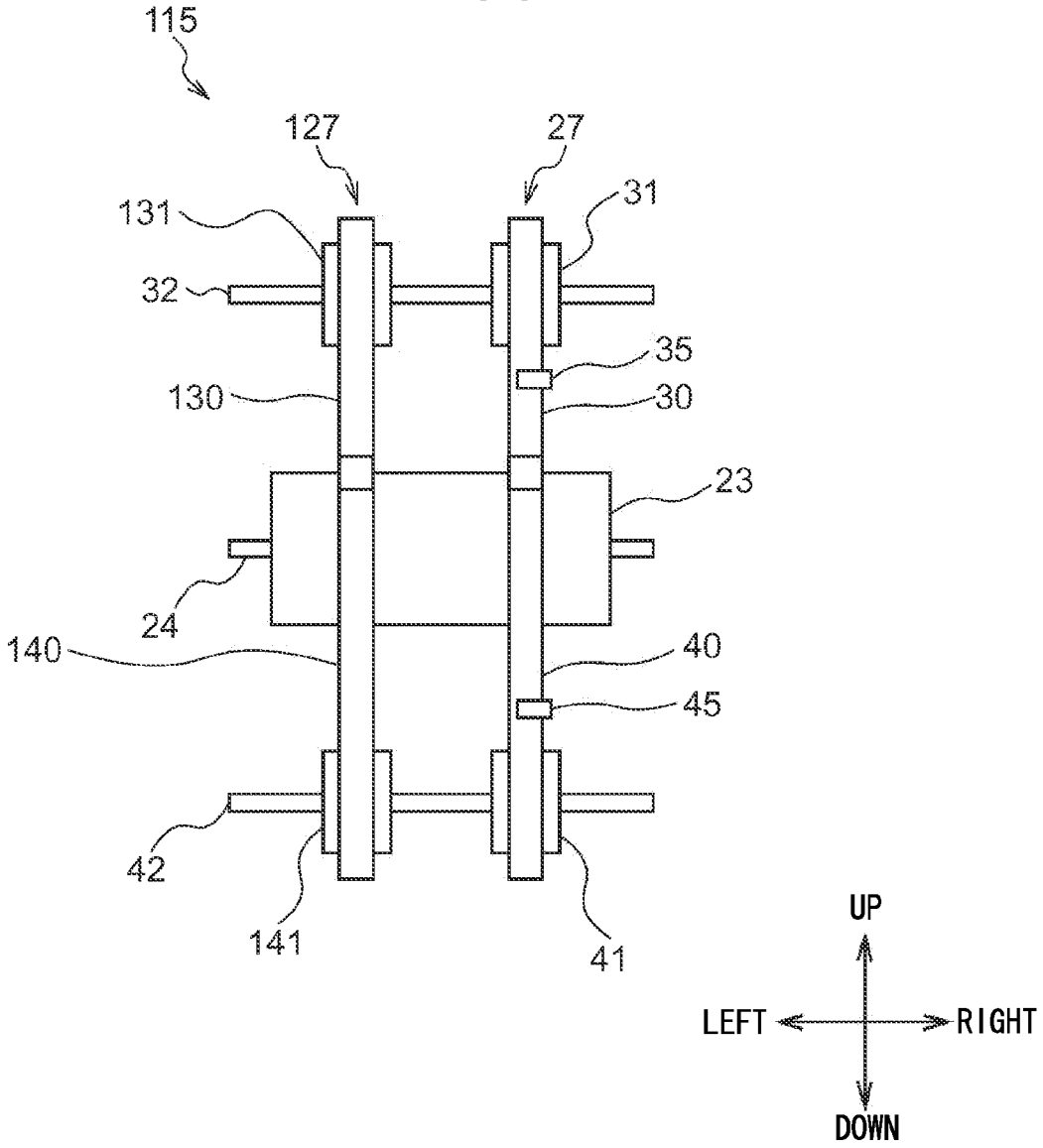
FIG. 8B is a rear side view illustrating a configuration of a temporary holding section according to the second exemplary embodiment.

As illustrated in FIG. 8A and FIG. 8B, that correspond to FIG. 3A and FIG. 3B, in the temporary holding section 115 the tape drive system 27 of the first exemplary embodiment is disposed toward the right side of the drum 23, and a tape drive system 127, of partially similar configuration to the tape drive system 27, is disposed toward the left side of the drum 23. The temporary holding section 115 is thus provided with the two tape drive systems 27 and 127.

The tape drive system 127 includes an outer tape 130, an outer reel 131, a pulley 133, an inner tape 140, an inner reel 141 and a pulley 143, respectively corresponding to the outer tape 30, the outer reel 31, the pulley 33, the inner tape 40, the inner reel 41 and the pulley 43 of the tape drive system 27.

Since the outer reel 131, the pulley 133, the inner reel 141 and the pulley 143 are respectively of similar configuration to the outer reel 31, the pulley 33, the inner reel 41 and the pulley 43, explanation thereof is omitted.

Figure 9:
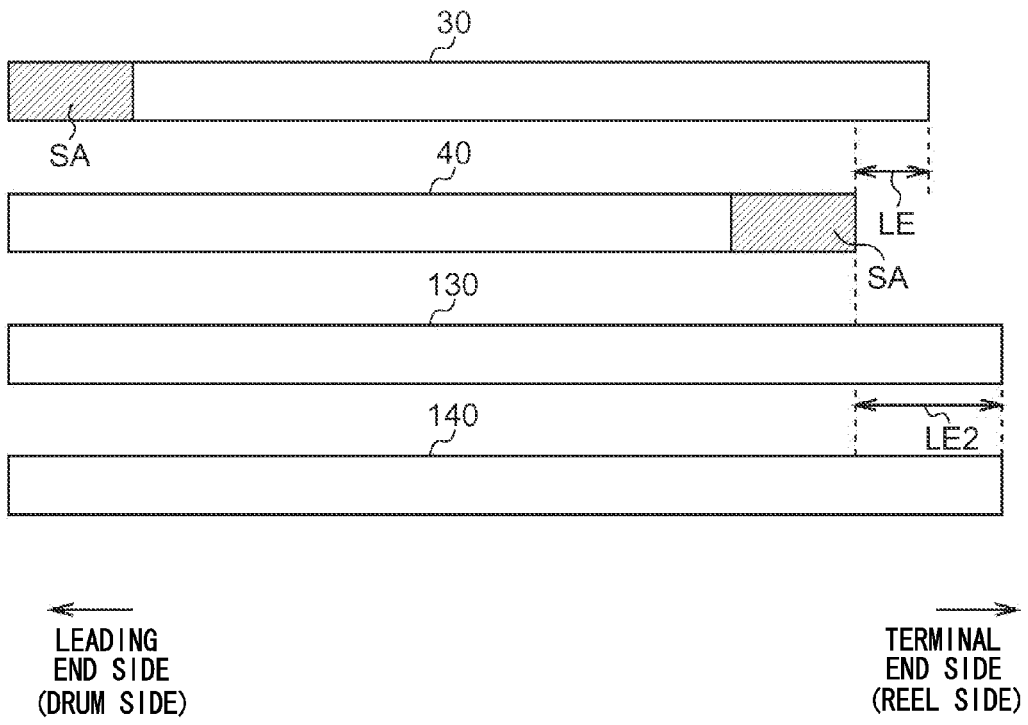
FIG. 9 is a schematic side view illustrating a configuration of tapes according to the second exemplary embodiment.

As illustrated in FIG. 9, neither the outer tape 130 nor the inner tape 140 are formed with a light-blocking region SA, and their respective tape lengths are formed longer than the inner tape 40 by an additional length LE2.

Explanation is given regarding the appearance of the external diameter (referred to below as the winding diameter) of the drum 23 when banknotes BL are wound onto the circumferential surface, before an explanation regarding the additional length LE2.

In a case in which, for example, wrinkled or creased banknotes BL are wound onto the drum 23 in the temporary holding section 115, the external diameter (referred to below as the winding diameter), including the banknotes BL that have been wound onto the circumferential surface of the drum 23, increases and gives an enlarged state compared to when flat banknotes BL are wound onto the drum 23.

Figure 10A:
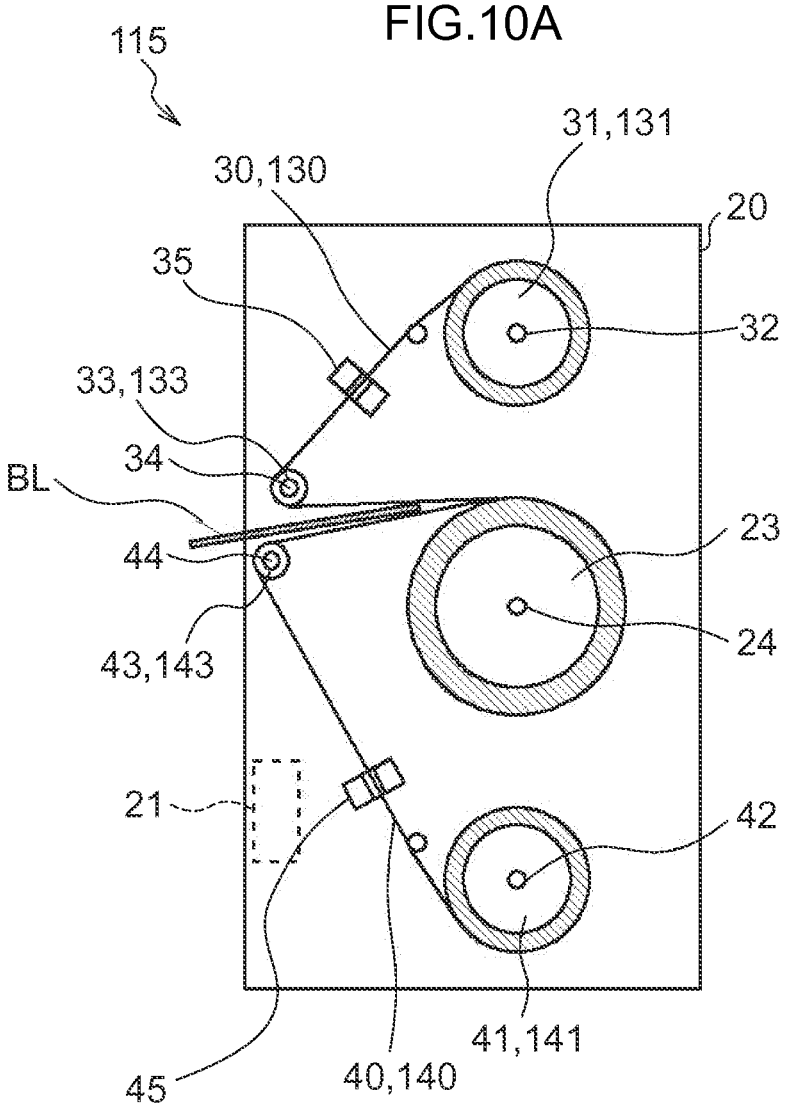
FIG. 10A is a right side view illustrating a state in which uneven winding diameter has developed in the second exemplary embodiment.
Figure 10B:
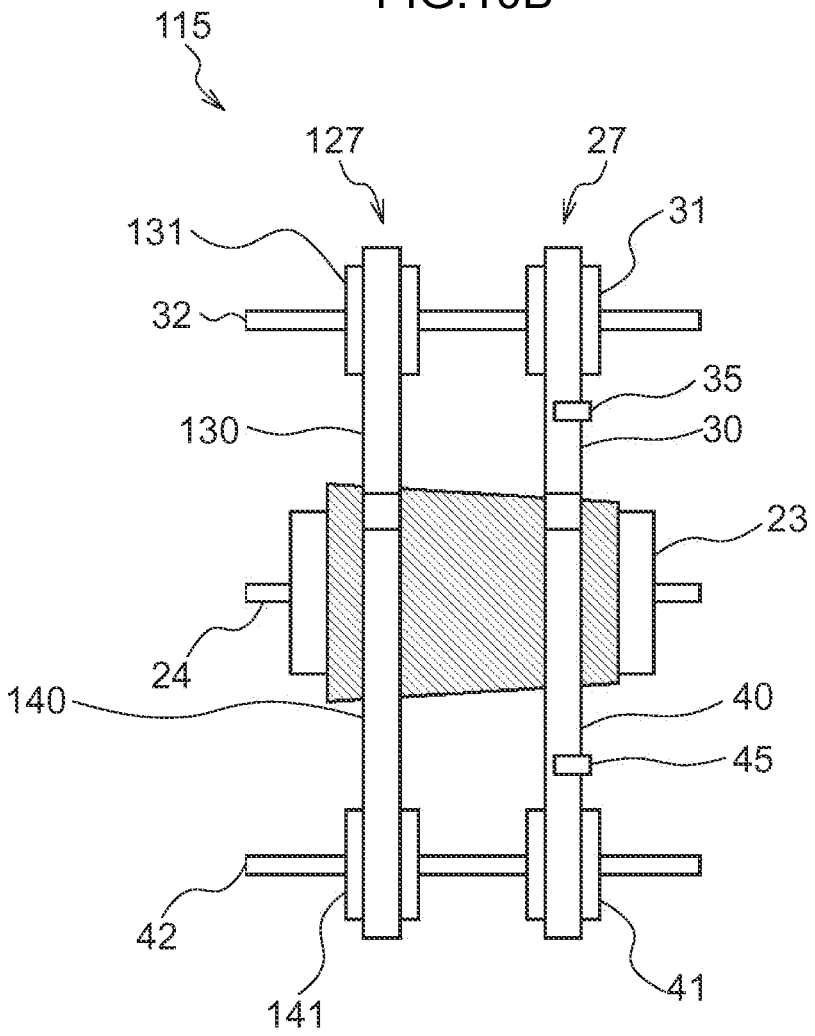
FIG. 10B is a rear side view illustrating a state in which uneven winding diameter has developed in the second exemplary embodiment.

In particular, in the temporary holding section 115, in a case in which, for example, wrinkles or creases are concentrated at one side in the length direction of the banknotes BL, then as illustrated in FIG. 10A and FIG. 10B the winding diameter (enlargement) of the drum also becomes uneven, and the length of tape wound onto the drum differs between the respective tape drive systems.

As illustrated in FIG. 10A and FIG. 10B, if the winding diameter of the drum 23 is greater on the tape drive system 127 side than on the tape drive system 27 side, then, according to the difference in winding diameter, the length of the outer tape 130 and the inner tape 140 that is wound onto the drum 23 (referred to below as the winding length) becomes longer by a winding length difference LR than the winding length of the outer tape 30 and the inner tape 40.

More specifically, for example, in a case in which a maximum storage number of banknotes BL has been wound onto the drum 23 in the temporary holding section 115, the tape drive system 27 side winding diameter is 106 mm, while the tape drive system 127 side winding diameter is 114 mm, although detailed explanation of the calculations is omitted, the respective winding lengths are about 29 m and about 32 m, giving a winding length difference LR of about 3 m.

The winding length difference LR is sufficiently longer than the cutout length LC (about 150 mm) explained in the first exemplary embodiment.

Accordingly, in the temporary holding section 115, the additional length LE2 is set at a value longer than the winding length difference LR, and therefore also sufficiently longer than the cutout length LC, such that the length of the outer tape 130 and inner tape 140 is longer than the inner tape 40 by the additional length LE2.

Note that the tape drive system 127 is not provided with tape sensors corresponding to the tape sensors 35 and 45.

In the temporary holding section 115, take-up operations and rewind operations are executed according to the take-up processing sequence RT1 and the rewind processing sequence RT2, similarly to in the first exemplary embodiment.

In the temporary holding section 115, the tape length of the outer tape 30, and the tape length of the outer tape 130 and the inner tape 140, that are not formed with light-blocking regions SA at their terminal-end portions, are set longer by the additional length LE, and the additional length LE2, respectively than the length of the inner tape 40, formed with the light-blocking region SA at the terminal-end portion. The tape sensor 45 detects the light-blocking region SA to determine that the tape position is at the terminal-end portion.

2-2. Operation and Effects

Similarly to in the first exemplary embodiment, in the temporary holding section 115 according to the second exemplary embodiment configured as described above, the light-blocking region SA is provided at the leading-end portion of the outer tape 30 and is detected by the tape sensor 35. Moreover, the light-blocking region SA provided at the terminal-end portion of the inner tape 40 is detected by the tape sensor 45.

Accordingly, similarly to in the first exemplary embodiment, the temporary holding section 115 is able to detect the light-blocking region SA of the inner tape 40 in the take-up operation of the drum 23 to determine that a tape position is the terminal-end portion and to stop the rotation of the drum 23.

In the temporary holding section 115, the tape lengths of the outer tape 130 and the inner tape 140 that are not formed with the light-blocking region SA at a terminal-end portion are set longer than the inner tape 40 that is formed with the light-blocking region SA at the terminal-end portion by the additional length LE2, namely are configured sufficiently longer than the winding length difference LR.

Accordingly, in the temporary holding section 115, the tape drive system 27 is able to detect the light-blocking region SA of the inner tape 40 with the tape sensor 45 and reliably stop rotation of the drum 23 before reaching the terminal-end portions of the tape drive system 127 side outer tape 130 and inner tape 140, even if the winding diameter on the tape drive system 127 side is greater than the winding diameter on the tape drive system 27 side (see FIG. 10A and FIG. 10B).

In the temporary holding section 115, the tape length of the outer tape 30 that is not formed with the light-blocking region SA at the terminal-end portion is configured longer by the additional length LE than the inner tape 40 that is formed with the light-blocking region SA at the terminal-end portion. The tape lengths of the outer tape 130 and the inner tape 140 are configured longer than the inner tape 40 by the additional length LE2. Namely, in the temporary holding section 115 the tape lengths of the outer tape 30, and the tape lengths of the outer tape 130 and the inner tape 140, are configured longer than the inner tape 40 by sufficiently more than the cutout length LC.

Therefore, in the temporary holding section 115, the outer tape 30, and the outer tape 130 and the inner tape 140, can still be maintained in a state longer than the inner tape 40, even in the event that, for example, an obstruction to the outer tape 30, or to the outer tape 130 or the inner tape 140 occurred and any tape is trimmed by the cutout length LC.

Moreover, in the temporary holding section 115, even if the inner tape 40 is trimmed by the cutout length LC, the outer tape 30, and the outer tape 130 and the inner tape 140 can obviously still be maintained in a state longer than the inner tape 40.

Accordingly, in the temporary holding section 115, even if a take-up operation is performed in a state in which the outer tape 30 or the outer tape 130, or the inner tape 40 or the inner tape 140, has been trimmed, the tape sensor 45 may detect the light-blocking region SA of the inner tape 40 and may stop rotation of the drum 23 before reaching the terminal-end portions of the outer tape 30, and of the outer tape 130 and the inner tape 140. There is accordingly no concern of damage to the respective tapes as a result of imparting excessive tension.

Accordingly, in the temporary holding section 115, even if an uneven winding diameter develops, or even if a tape has been trimmed, rotation of the drum 23 in a take-up operation can be stopped before reaching the terminal-end portions of the respective tapes. Irregular operation and damage as a result of imparting excessive tension to the respective tapes can accordingly be forestalled, enabling stable operation.

The temporary holding section 115 moreover does not require tape sensors to be provided in the additional tape drive system 127, and there is no need to form light-blocking regions SA to the outer tape 130 and the inner tape 140, meaning that an increase in the number of components and complexity of manufacturing process due to a modified configuration, as well as, for example, an associated increase in manufacturing cost compared to the first exemplary embodiment, can be suppressed to a minimum.

In other respects, the temporary holding section 115 can obtain similar operation and effects to the temporary holding section 15 according to the first exemplary embodiment.

According to the second exemplary embodiment configured as described above, in a take-up operation, the temporary holding section 115 detects by the tape sensor 45 the light-blocking region SA provided at the terminal-end portion of the inner tape 40 in order to determine that the tape position is the terminal-end portion and to stop rotation of the drum 23. Moreover, in the temporary holding section 115, the tape length of the outer tape 130 and the inner tape 140 is configured longer than the inner tape 40 by the additional length LE2, thereby enabling the tape sensor 45 to detect the light-blocking region SA of the inner tape 40 and to stop rotation of the drum 23 before reaching the terminal-end portions of the respective tapes, even if an uneven winding diameter has developed on the drum 23, or if one of the tapes has been trimmed Damage to the respective tapes as a result of imparting excessive tension can accordingly be forestalled.

3. Third Exemplary Embodiment

An automated teller machine 201 (FIG. 1) of a third exemplary embodiment differs from the automated teller machine 1 according to the first exemplary embodiment in the point that a temporary holding section 215 is provided in place of the temporary holding section 15. Other portions are of similar configuration.

3-1. Configuration of Temporary Holding Section

Figure 11A:
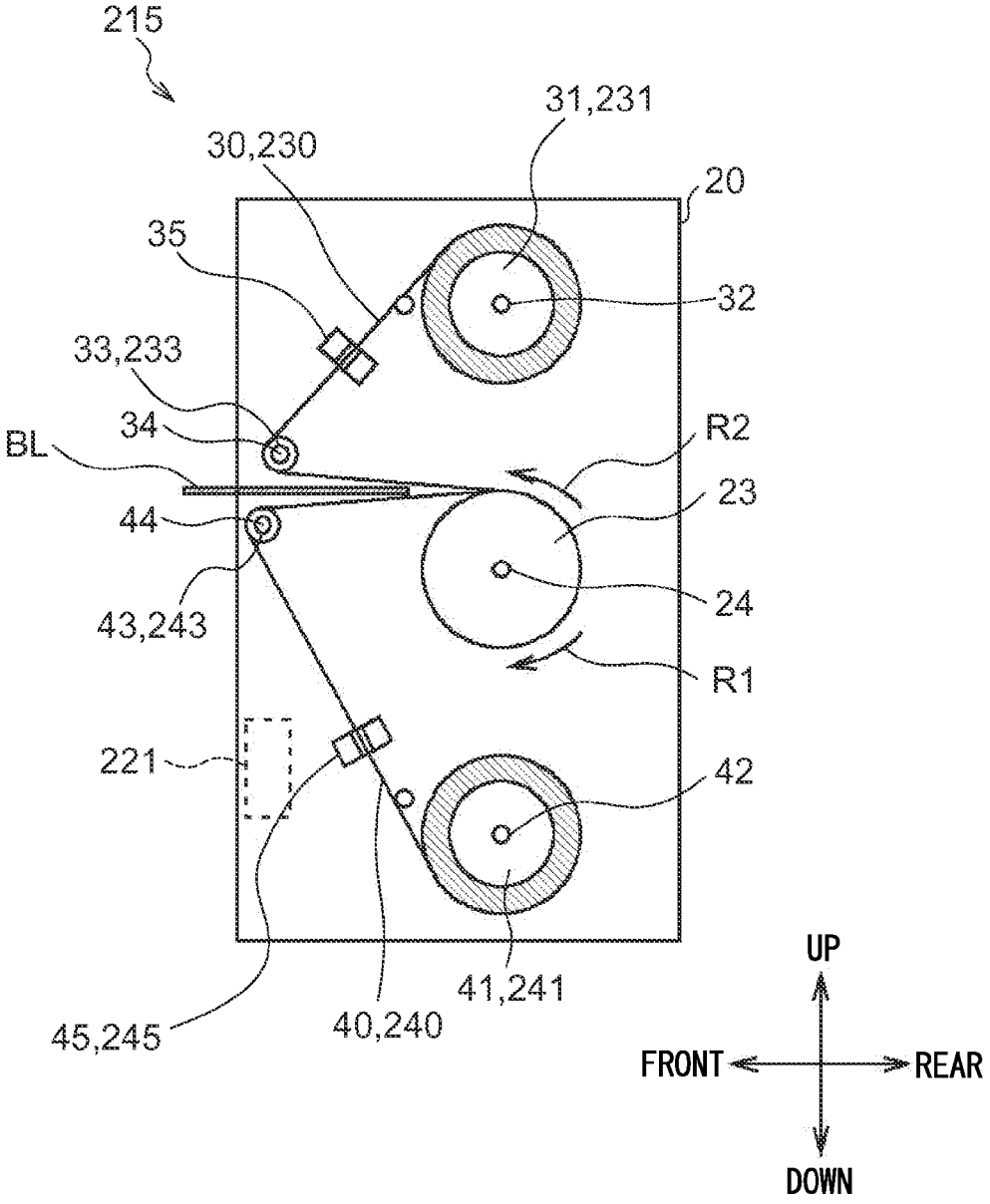
FIG. 11A is a right side view illustrating a configuration of a temporary holding section according to a third exemplary embodiment.
Figure 11B:
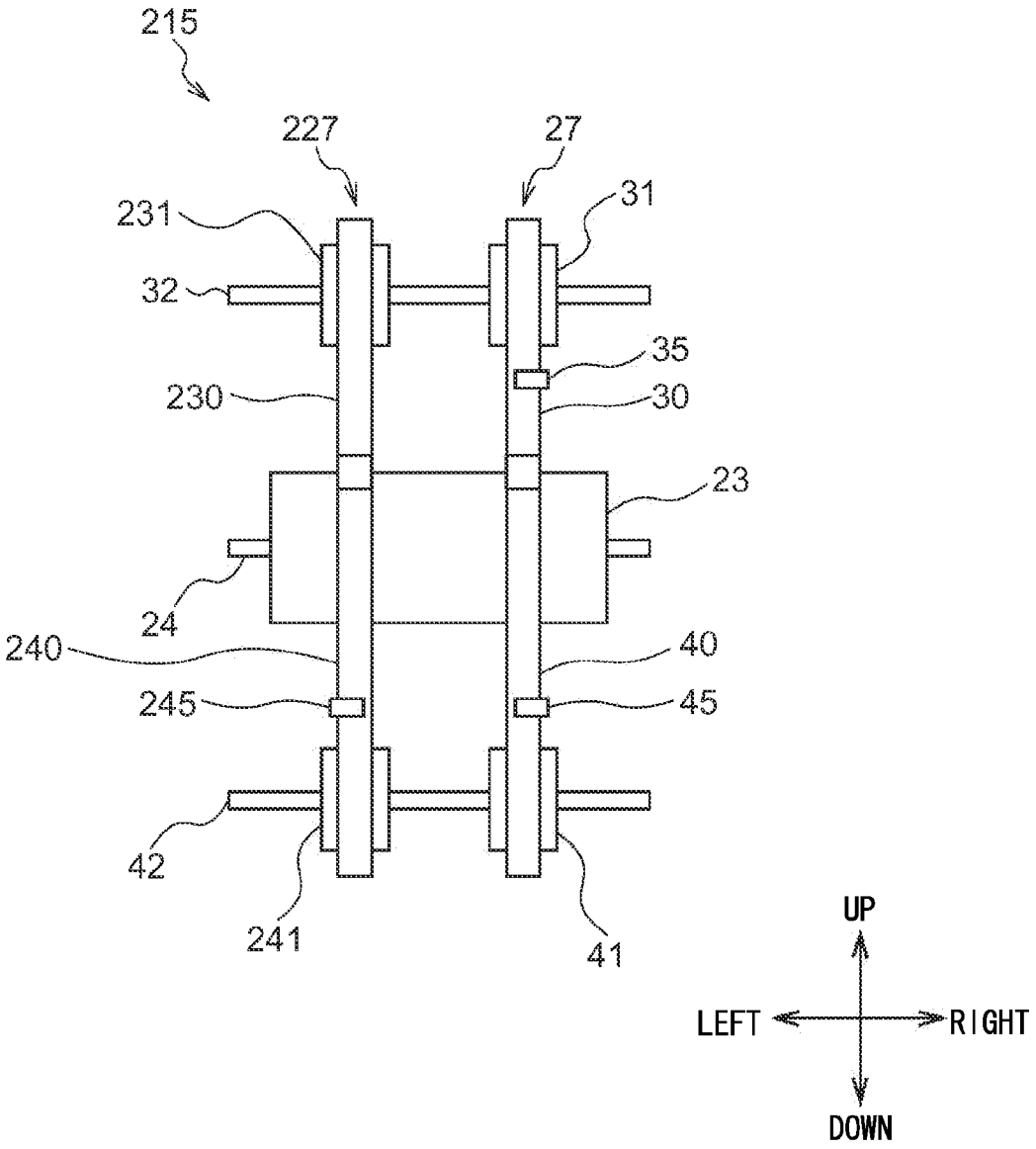
FIG. 11B is a rear side view illustrating a configuration of a temporary holding section according to the third exemplary embodiment.

As illustrated in FIG. 11A and FIG. 11B, that correspond to FIG. 3A and FIG. 3B, in the temporary holding section 215 the tape drive system 27 of the first exemplary embodiment is disposed toward the right side of the drum 23, and a tape drive system 227 of partially similar configuration to the tape drive system 27 is disposed toward the left side of the drum 23. The temporary holding section 215 is namely provided with two tape drive systems 27 and 227.

The tape drive system 227 includes an outer tape 230, an outer reel 231, a pulley 233, an inner tape 240, an inner reel 241, a pulley 243, and a tape sensor 245 respectively corresponding to the outer tape 30, the outer reel 31, the pulley 33, the inner tape 40, the inner reel 41, the pulley 43, and the tape sensor 45 of the tape drive system 27.

Since the outer reel 231, the pulley 233, the inner reel 241, the pulley 243, and the tape sensor 245 are respectively of similar configuration to the outer reel 31, the pulley 33, the inner reel 41, the pulley 43, and the tape sensor 45, explanation thereof is omitted.

Figure 12:
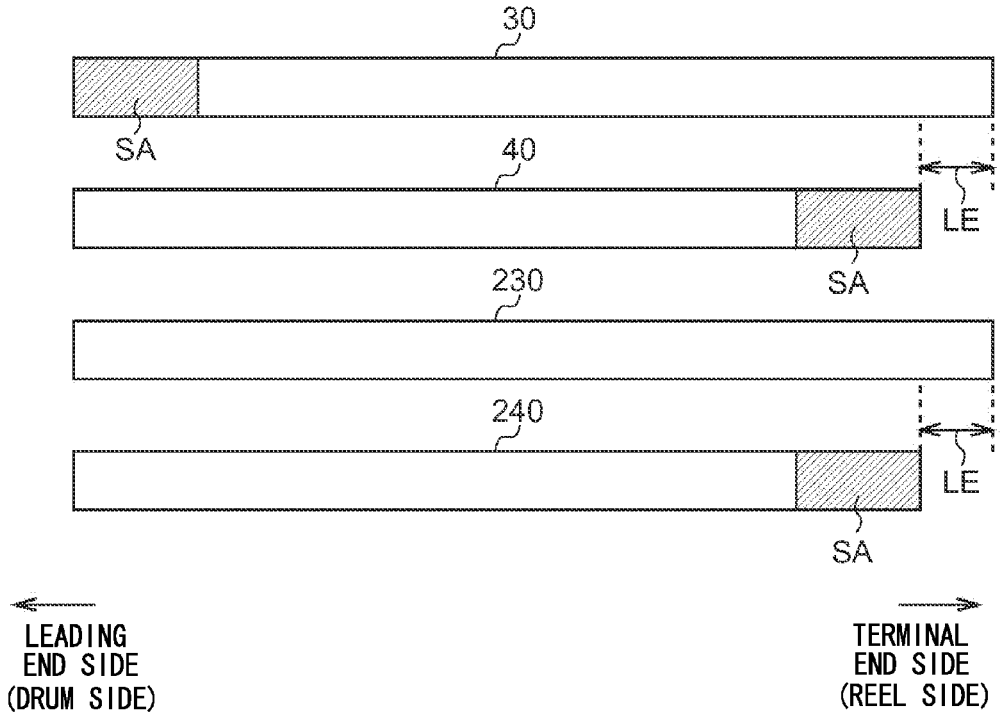
FIG. 12 is a schematic side view illustrating a configuration of tapes according to the third exemplary embodiment.
Figure 13A:
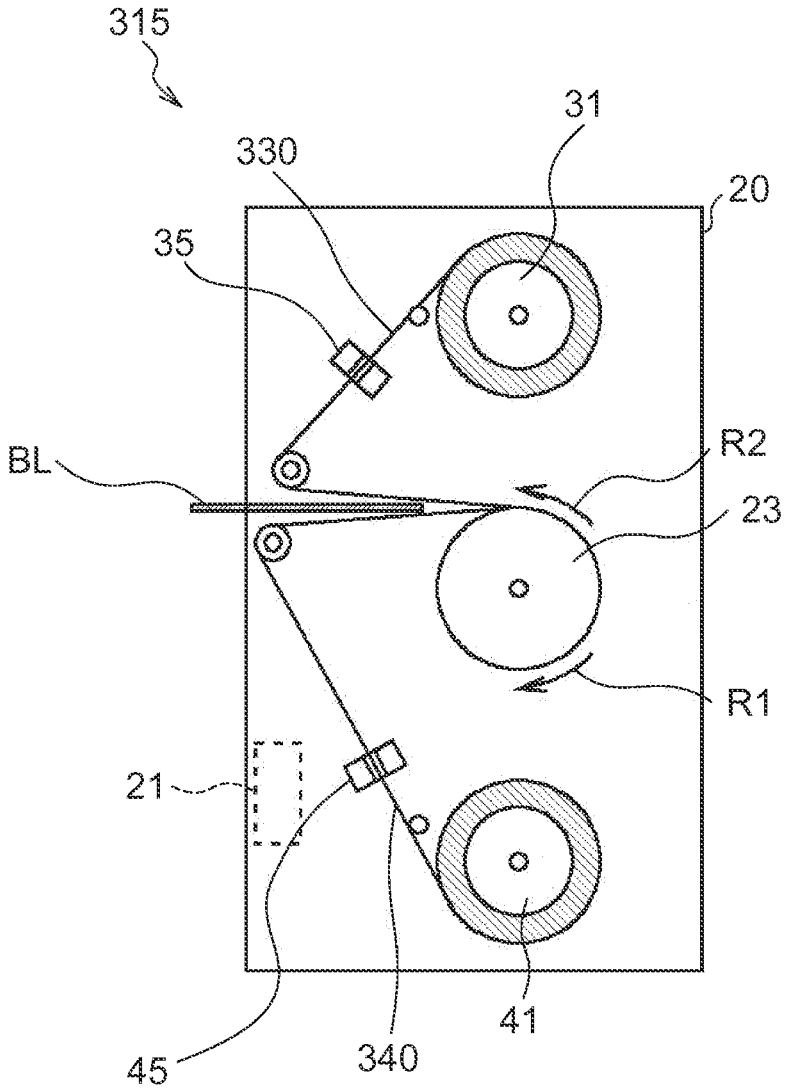
FIG.13A Prior Art
FIG. 13A is a right side view illustrating a configuration of a conventional temporary holding section.
Figure 13B:
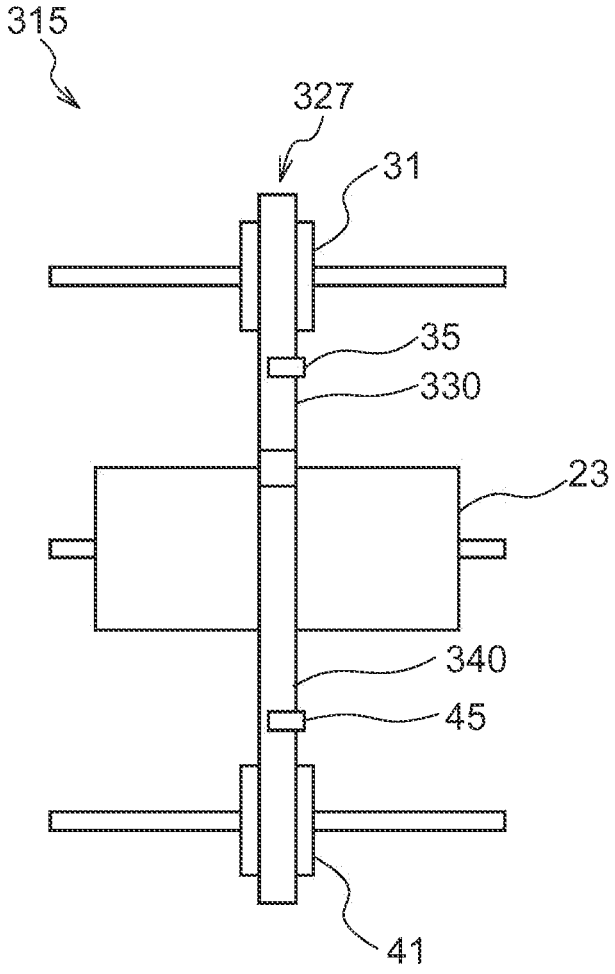
FIG.13B Prior Art
FIG. 13B is a rear side view illustrating a configuration of a conventional temporary holding section.
Figure 14:
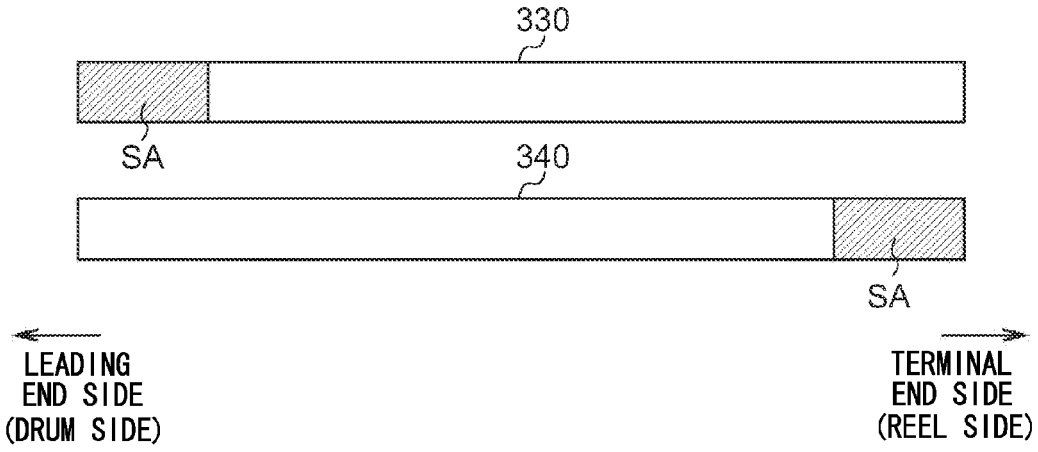
FIG.14 Prior Art
FIG. 14 is a schematic drawing illustrating a configuration of conventional tapes.

As illustrated in FIG. 12, the outer tape 230 and the inner tape 240 are respectively of similar configuration to the outer tape 30 and the inner tape 40. Namely, the outer tape 230, not formed with a light-blocking region SA at a terminal-end portion, is configured longer by the additional length LE than the inner tape 240 that has a light-blocking region SA formed at a terminal-end portion.

Note that although a controller 221 of the temporary holding section 215 performs the take-up processing sequence RT1 and rewind processing sequence RT2 similarly to the controller 21, at step SP2 of the take-up processing sequence RT1, light reception signals are obtained from both the tape sensors 45 and 245, and at step SP3 determination is made as to whether or not all of the light reception signals are the "bright" level.

The tape drive system 227 of the temporary holding section 215 accordingly includes the inner tape 240 that is formed with the light-blocking region SA at the terminal-end portion, and the outer tape 230 that is not formed with the light-blocking region SA at the terminal-end portion and is longer than the inner tape 240 by the additional length LE.

3-2. Operation and Effects

In the temporary holding section 215 according to the third exemplary embodiment configured as described above, the leading-end portion of the outer tape 30 is provided with the light-blocking region SA that is detected by the tape sensor 35, and the terminal-end portions of the inner tapes 40 and 240 are provided with light-blocking regions SA that are detected by the tape sensors 45 and 245.

The temporary holding section 215 is accordingly capable of detecting the light-blocking regions SA of the inner tapes 40 and 240 to make determination that the tape position is the terminal-end portion, and to stop rotation of the drum 23, during a take-up operation of the drum 23.

Moreover, in the temporary holding section 215, similarly to the outer tape 30, the tape length of the outer tape 230 that is not formed with the light-blocking region SA is configured longer by the additional length LE, namely by sufficiently longer than the cutout length LC, than the inner tapes 40 and 240 that are formed with the light-blocking regions SA at the inner tape terminal-end portions.

Accordingly, in the temporary holding section 215, the outer tape 30 and the outer tape 230 can still be maintained in a state longer than the inner tape 40 and the inner tape 240, even for example in the event that an obstruction in the outer tape 30 or the outer tape 230 occurred and any tape is trimmed by the cutout length LC.

Note that in the temporary holding section 215, even if the inner tape 40 or the inner tape 240 is trimmed by the cutout length LC, the outer tapes 30 and 230 can obviously be maintained in a state longer than the inner tape 40 or the inner tape 240.

Accordingly, in the temporary holding section 215, even if a take-up operation is performed in a state in which one of the outer tape 30, the outer tape 230, the inner tape 40 or the inner tape 240 has been trimmed, the tape sensor 45 or the tape sensor 245 may detect the light-blocking region SA of the inner tape 40, or the inner tape 240, and can stop rotation of the drum 23 before reaching the terminal-end portion of the outer tape 30 or the outer tape 230. There is accordingly no concern of damage to the respective tapes as a result of imparting excessive tension.

Moreover, the temporary holding section 215 is configured such that the inner tape 240 of the tape drive system 227, as well as the inner tape 40 of the tape drive system 27, is provided with the terminal-end portion light-blocking region SA, which is detected by the tape sensor 245.

Therefore, in the temporary holding section 215, even if the winding diameter becomes larger on either the tape drive system 27 side or the tape drive system 227 side, similarly to as shown in FIG. 10A and FIG. 10B, the tape sensor 45 or the tape sensor 245 is able to first detect the corresponding light-blocking region SA of the inner tape 40 or the inner tape 240 on the side with the larger winding diameter. As a result, rotation of the drum 23 can be reliably stopped, and no excessive tension is imparted to any of the tapes.

In other respects, the temporary holding section 215 is able to obtain similar operation and effects to the temporary holding section 15 according to the first exemplary embodiment.

According to the third exemplary embodiment configured as described above, the temporary holding section 215 detects by the tape sensors 45 and 245 the light-blocking regions SA formed to the respective terminal-end portions of the inner tapes 40 and 240 during the take-up operation of the drum 23 even if an uneven winding diameter has developed, in order to determine that the tape position is the terminal-end portion, and to stop rotation of the drum 23. Moreover, the tape lengths of the outer tapes 30 and 230 of the temporary holding section 215 are configured longer than the inner tapes 40 and 240 by the additional length LE. Accordingly, even if one of the tapes has been trimmed, the light-blocking regions SA of the inner tapes 40 and 240 can still be detected by the tape sensors 45 and 245 and rotation of the drum 23 can be stopped, thereby forestalling damage to the respective tapes as a result of imparting excessive tension.

4. Other Exemplary Embodiments

Note that in the first exemplary embodiment described above, explanation is given regarding a case in which the leading-end portion of the outer tape 30 is detected, and the terminal-end portion of the inner tape 40 is detected.

However, the present invention is not limited thereto, and, for example, the leading-end portion of the inner tape 40 may be detected and the terminal-end portion of the outer tape 30 may be detected. This also applies to the second and third exemplary embodiments.

In the second exemplary embodiment described above, explanation is given regarding a case in which the light-blocking region SA is only provided to the leading-end portion of the outer tape 30, namely is only provided on one of the tapes.

However, the present invention is not limited thereto, and, for example, light-blocking regions SA may be provided at the leading-end portions of two or more of the tapes, for example, by providing a light-blocking region SA to the leading-end portion of the outer tape 130. This also applies to the third exemplary embodiment.

In the first exemplary embodiment described above, explanation is given regarding a case in which determination as to whether or not the tape position has reached the terminal-end portion in a take-up operation, and determination as to whether or not the tape position has reached the leading-end portion in a rewind operation, is made based on the light reception signals obtained from the tape sensors.

However, the present invention is not limited thereto, and configuration may be made, for example, such that determination is only made as to whether or not the tape position is the terminal-end portion based on light reception signals obtained from the tape sensors, in cases in which detection as to whether or not the tape position is the leading-end portion can be made using a different method. This also applies to the second and third exemplary embodiments.

In the first exemplary embodiment described above, explanation is given regarding a case in which the additional length LE is configured sufficiently longer than the cutout length LC of a trimming operation based on an assumption that a single tape would be subject to one trimming operation at the most.

However, the present invention is not limited thereto, and, for example, in a case in which is it is possible that up to three trimming operations may be performed on a single tape, the additional length LE may be configured to be sufficiently longer than "three times the cutout length LC", corresponding to three trimming operations. This also applies to the second and third exemplary embodiments.

Moreover, in the second exemplary embodiment described above, explanation is given regarding a case in which the winding length difference LR is longer than the cutout length LC, and the additional length LE2 is given a longer value than the winding length difference LR, with the lengths of the outer tape 130 and the inner tape 140 set longer than the inner tape 40 by the additional length LE2.

However, the present invention is not limited thereto. For example, in a case in which the cutout length LC is longer than the winding length difference LR, the lengths of the outer tape 130 and the inner tape 140 may be configured longer than the inner tape 40 by the additional length LE, namely with a similar length to the outer tape 30. That is to say, it is sufficient that the lengths of the outer tape 130 and the inner tape 140 are set sufficiently longer than the longer length of the cutout length LC or the winding length difference LR, so as to be able to cope both with cases in which a tape has been trimmed and cases in which an uneven winding diameter has developed.

In the second exemplary embodiment described above, explanation is given regarding a case in which two tape drive systems are provided in the temporary holding section 115.

The present invention is, however, not limited thereto, and the temporary holding section 115 may be provided with three or more of the tape drive systems in order to achieve more stable winding of banknotes BL onto the drum 23. This also applies to the third exemplary embodiment.

In the first exemplary embodiment described above, explanation is given regarding a case in which each of the tapes is configured overall from a transparent material that allows the detection light to pass through, with the light-blocking regions SA that block the detection light being provided at portions at a leading-end portion and a terminal-end portion, and the respective tape sensors detect the light transmissivity of the detection light.

However, the present invention is not limited thereto and, for example, configuration may be made in which, a reflective region that reflects detection light is provided to each of the tapes at a leading-end portion and a terminal-end portion, with the tape sensors receiving the reflected detection light. Alternatively, the respective tapes may be configured by a material with light-blocking properties, with light-passing regions that allow light to pass through provided as appropriate at a leading-end portion or a terminal-end portion.

Moreover, the respective tapes may, for example, be configured by a non-magnetic body overall, with magnetized regions formed at portions of a leading-end portion and a terminal-end portion, and the magnetism or lack thereof is detected by a magnetic sensor. Namely, in the present invention, a leading-end portion and a terminal-end portion of the respective tapes may be provided with regions with contrasting physical properties to the overall tape, and this difference in physical properties may be detected by specific sensors. This also applies to the second exemplary embodiment and the third exemplary embodiment.

In the first exemplary embodiment described above, explanation is given regarding a case in which banknotes BL serve as the medium held by the temporary holding section 15 of the automated teller machine 1 that performs cash transactions with a customer in, for example, a financial institution.

However, the present invention is not limited thereto, and may, for example, be applied to a temporary holding section incorporated into an accounting system with which a cashier performs various cash transactions in, for example, a financial institution. Alternatively, the present invention may be applied to various devices that hold a paper sheet shaped medium such as shopping vouchers, cash vouchers, or entrance tickets. This also applies to the second and third exemplary embodiments.

In the first exemplary embodiment described above, explanation is given regarding a case in which the temporary holding section 15 serving as a medium processing device is configured by the drum 23 serving as a drum, the inner tape 40 that serves as a contrasting tape, the outer tape 30 that serves as a normal tape, the tape sensor 45 that serves as a sensor section, and the controller 21 that serves as a controller.

However, the present invention is not limited thereto, and the medium processing device may, for example, be configured by various other configurations of a drum, contrasting tape, normal tape, detection section, and controller.

Industrial Applicability

The present invention may be employed in various devices in which a paper shaped medium such as a banknote is temporarily held by being wound onto a drum together with a tape.

The invention claimed is:

1. A medium processing device, comprising:

a cylindrical drum that rotates about a central shaft;

one or more inner tapes that are withdrawn from an inner reel on which the inner tapes are wound in advance and are wound onto a circumferential surface of the drum, at one or more locations in an axial direction along the central shaft of the drum;

one or more outer tapes that are withdrawn from an outer reel on which the outer tapes are wound in advance and are wound onto the circumferential surface of the drum together with the inner tapes and a paper sheet shaped medium, with the medium interposed between the inner tapes and the outer tapes;

a contrasting region that has contrasting physical properties to other regions, and that is formed at a terminal-end portion that is an end portion at the inner reel side or the outer reel side of at least one of the inner tapes or the outer tapes;

a detection section that detects the physical properties at a tape position between the drum and the inner reel or between the drum and the outer reel, on a contrasting tape that is one of the inner tapes or the outer tapes formed with the contrasting region at the terminal-end portion; and a controller that controls rotation of the drum based on a detection result of the detection section, wherein a normal tape that is one of the inner tapes or the outer tapes not formed with the contrasting region at the terminal-end portion, has a length in a length direction that is longer than that of the contrasting tape by an additional length, the additional length being longer than a cutout length that is trimmed in a case in which an obstruction occurs in a portion of the normal tape.

2. The medium processing device of claim 1, wherein:

the contrasting tape is configured from a transmissive material that transmits a specific detection light;

the contrasting region blocks the detection light; and the detection section detects a proportion of the detection light transmitted through the contrasting tape at the tape position.

3. A medium processing device, comprising:

a cylindrical drum that rotates about a central shaft;

one or more inner tapes that are withdrawn from an inner reel on which the inner tapes are wound in advance and are wound onto a circumferential surface of the drum, at one or more locations in an axial direction along the central shaft of the drum;

one or more outer tapes that are withdrawn from an outer reel on which the outer tapes are wound in advance and are wound onto the circumferential surface of the drum together with the inner tapes and a paper sheet shaped medium, with the medium interposed between the inner tapes and the outer tapes;

a contrasting region that has contrasting physical properties to other regions, and that is formed at a terminal-end portion that is an end portion at the inner reel side or the outer reel side of at least one of the inner tapes or the outer tapes;

a detection section that detects the physical properties at a tape position between the drum and the inner reel or between the drum and the outer reel, on a contrasting tape that is one of the inner tapes or the outer tapes formed with the contrasting region at the terminal-end portion; and a controller that controls rotation of the drum based on a detection result of the detection section, wherein a normal tape that is one of the inner tapes or the outer tapes not formed with the contrasting region at the terminal-end portion, has a length in a length direction that is longer than that of the contrasting tape by an additional length, the additional length being longer than a winding length difference that is a difference in winding length between the plurality of inner tapes or between the plurality of outer tapes caused by unevenness along the axial direction in the thickness of the medium wound onto the circumferential surface of the drum.

4. The medium processing device of claim 3, wherein the additional length is longer than a longer length between a cutout length that is trimmed in a case in which an obstruction occurs in a portion of the normal tape, and the winding length difference.

5. The medium processing device of claim 3, wherein:

the contrasting tape is configured from a transmissive material that transmits a specific detection light;

the contrasting region blocks the detection light; and the detection section detects a proportion of the detection light transmitted through the contrasting tape at the tape position.

* * * * *